US009188339B2

(12) United States Patent
Headland

(10) Patent No.: US 9,188,339 B2
(45) Date of Patent: Nov. 17, 2015

(54) SWIRLER FOR MIXING FUEL AND AIR

(75) Inventor: Paul Headland, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 1294 days.

(21) Appl. No.: 13/057,190

(22) PCT Filed: Jun. 24, 2009

(86) PCT No.: PCT/EP2009/057863

§ 371 (c)(1),
(2), (4) Date: Feb. 2, 2011

(87) PCT Pub. No.: WO2010/015457

PCT Pub. Date: Feb. 11, 2010

(65) Prior Publication Data

US 2011/0138815 A1 Jun. 16, 2011

(30) Foreign Application Priority Data

Aug. 5, 2008 (EP) ..... 08014023

(51) Int. Cl.

| | |
|---|---|
| ***F23R 3/14*** | (2006.01) |
| ***F23R 3/12*** | (2006.01) |
| ***F23C 7/00*** | (2006.01) |
| ***F23R 3/28*** | (2006.01) |

(52) U.S. Cl.

CPC . *F23R 3/14* (2013.01); *F23C 7/004* (2013.01); *F23R 3/12* (2013.01); *F23R 3/286* (2013.01); *F23C 2900/07001* (2013.01)

(58) Field of Classification Search

CPC ..... F23R 3/14; F23R 3/286; F23R 3/12; F23R 3/343

USPC ..... 60/737, 772

See application file for complete search history.

(56) References Cited

U.S. PATENT DOCUMENTS

| | | | | |
|---|---|---|---|---|
| 5,947,081 | A | 9/1999 | Kim | |
| 2002/0174656 | A1 * | 11/2002 | Hein | 60/737 |
| 2006/0257807 | A1 * | 11/2006 | Hicks et al. | 431/354 |
| 2009/0272116 | A1 * | 11/2009 | Bland | 60/737 |

FOREIGN PATENT DOCUMENTS

| | | | | |
|---|---|---|---|---|
| DE | 19542164 | A1 | 5/1997 | |
| EP | 1847778 | A1 | 10/2007 | |
| EP | 1867925 | * | 12/2007 | F23R 3/14 |
| EP | 1867925 | A1 | 12/2007 | |
| EP | 1919481 | A2 | 5/2008 | |
| GB | 2435508 | B | 8/2011 | |
| RU | 2062405 | C1 | 6/1996 | |
| RU | 2157954 | C2 | 10/2000 | |
| WO | WO 2004057236 | A2 | 7/2004 | |

* cited by examiner

*Primary Examiner* — Phutthiwat Wongwian
*Assistant Examiner* — Marc Amar

(57) ABSTRACT

A swirler for mixing fuel and air is provided. The swirler includes a plurality of vanes arranged on a reference circle diameter which, together with a first longitudinal end face of the vanes disposed on a first wall and a second wall disposed on an opposing second longitudinal end face of the vanes, form a flow channel. In this arrangement at least one injection orifice in the first wall and at least one further injection orifice in the second wall open into a flow channel. The arrangement of the at least two mutually opposing injection orifices in the wall of the swirler makes for a homogeneous distribution of the fuel in the flow channel and ensures a uniform mixing of the air with the fuel. This results in uniform and low-NOx combustion of the fuel/air mixture in a burner.

18 Claims, 2 Drawing Sheets

SWIRLER FOR MIXING FUEL AND AIR

CROSS REFERENCE TO RELATED APPLICATIONS

This application is the US National Stage of International Application No. PCT/EP2009/057863, filed Jun. 24, 2009 and claims the benefit thereof. The International Application claims the benefits of European Patent Office application No. 08014023.9 EP filed Aug. 5, 2008. All of the applications are incorporated by reference herein in their entirety.

FIELD OF INVENTION

The invention relates to a swirler for mixing fuel and air, comprising a plurality of vanes arranged on a reference circle diameter which, together with a first wall disposed on a first longitudinal end face of the vanes and a second wall disposed on an opposing second longitudinal end face of the vanes, form a flow channel, the first wall having at least one injection orifice opening into the flow channel, the flow channel being formed in such a way that the air is mixed with the fuel when streaming through the flow channel from a high-pressure side to a low-pressure side. The invention also relates to a burner, in particular for a gas turbine, having a swirler as claimed in the claims, as well as to a gas turbine having a burner of said kind.

BACKGROUND OF INVENTION

Protection of the environment is an increasingly important concern at the present time, not only in politics but also in the economy. Many governments have enacted restrictive environmental regulations relating to the operation of fossil fuel combustion systems. Furthermore there are numerous tax advantages for companies operating environmentally friendly installations or converting their existing systems.

Reducing NOx emissions is one of the factors that play an important role in the burning of fossil fuels.

Since NOx emissions increase considerably at combustion temperatures above 1800°, it is the aim of all reduction measures to keep the combustion temperature below this temperature. Essentially, two measures are known for achieving this aim. In the case of the first measure the combustion takes place substoichiometrically, i.e. the combustion takes place with an excess of air. In this case the increased air mass ensures heat is absorbed in the reaction zone of the combustor and thereby limits the temperature in the combustion chamber to a temperature at which only small quantities of NOx are produced.

The second NOx reduction measure consists in a particularly good mixing of the fuel and the air before the mixture is injected into the combustion chamber. The better the blending of the air/fuel mixture prior to combustion, the lower is the probability that zones in which an increased fuel fraction occurs (hotspots) will form in the combustion chamber. The zones would otherwise lead to local temperature increases in the combustion chamber and consequently to an increase in NOx emissions.

In order to achieve a good mixing of fuel and air, swirlers according to the claims have been used hitherto. A swirler of this kind is disclosed in EP 18 67 925 A1 for example. The swirler comprises a plurality of vanes arranged on a reference circle diameter which, together with a first wall disposed on a first longitudinal end face of the vanes and a second wall disposed on an opposing second longitudinal end face of the vanes, form a flow channel. The air streams through the swirler from an externally located high-pressure side to the internal low-pressure side. The fuel is supplied to the flow channel via injection orifices in one of the two walls as well as in the vanes. In the process the injected fuel mixes with the air streaming through the flow channel, thereby producing a fuel/air mixture which subsequently enters the combustion chamber.

SUMMARY OF INVENTION

The object of the present invention is to achieve a further improved mixing of the air/fuel mixture. It is also an object of the present invention to provide a burner and a gas turbine having such a burner which has low NOx emissions.

The object is achieved by means of the features of the independent claim.

Advantageous embodiments and developments which can be used individually or in combination with one another are the subject matter of the dependent claims.

The inventive swirler for mixing fuel and air, comprising a plurality of vanes arranged on a reference circle diameter which, together with a first wall disposed on a first longitudinal end face of the vanes and a second wall disposed on an opposing second longitudinal end face of the vanes, form a flow channel, the first wall having at least one injection orifice opening into the respective flow channel, the flow channel being formed in such a way that the air is mixed with the fuel when streaming through the flow channel from a high-pressure side to a low-pressure side, is characterized in that the fuel can be additionally injected into the flow channel through at least one further injection orifice in the second wall. What is achieved as a result of the additional injection orifice in the second wall is that the fuel is injected into the flow channel more uniformly over the entire flow cross-section. This results in a significantly improved mixing of the fuel/air mixture even in the case of short flow paths. Owing to the better mixing a substantial reduction in NOx formation is achieved during the combustion of the fuel/air mixture in the combustion chamber.

An advantageous embodiment of the invention provides that the injection orifices situated opposite one another in each case are arranged in axial alignment with respect to one another. What can be achieved in this way is that the fuel jets injected into the flow channel collide with one another, thus producing a further improvement in the mixing of the fuel/air mixture.

A further advantageous embodiment of the invention provides that additional injection orifices are disposed in the vanes. This ensures a further improvement in the mixing of the fuel/air mixture in the flow channel and an additional NOx reduction during the combustion of the fuel/air mixture in the combustion chamber.

The injection orifices in the first wall are preferably connected to at least a first annular channel and the injection orifices in the second wall to at least a second annular channel via which fuel can be supplied to the injection orifices. The annular channel ensures a uniform distribution of the fuel to be injected to the individual injection nozzles. By this means a uniform injection over all the injection orifices is achieved, thereby ensuring a homogeneous distribution of the fuel in the flow channel and hence to a good blending of the fuel/air mixture in the flow channel. Furthermore the design effort involved in realizing the swirler is substantially reduced since no individual supply lines to the injection orifices are necessary. The compact design also reduces the assembly overhead as well as the production costs.

In this case the first and/or second wall of the swirler is particularly advantageously part of the first and second annular channel respectively. On the one hand this can save on material, and on the other hand the number of potential leakage points is reduced, thus increasing operational reliability.

A further advantageous embodiment of the swirler provides that the first and/or second annular channel is embodied as a separate component. The separate embodiment of the annular channel affords the advantage that the annular channel can be more easily adapted to different operating parameters.

The invention also relates to a burner, in particular for a gas turbine, which comprises a swirler as claimed in the claims. The use of a swirler of said kind for a burner enables low-NOx combustion on account of the low combustion chamber temperature.

The use of the swirler is advantageous in particular in the case of burners for gas turbines, since in gas turbines very high combustion temperatures are typically present and consequently increased NOx emissions occur.

The invention also relates to a method for mixing air and fuel by means of a swirler according to the invention, said method comprising the steps: supplying air into the flow channel through an external inlet; supplying fuel via injection orifices which are disposed both in the first wall and in the second wall; distributing the fuel over the cross-section of the flow channel; mixing the fuel and the air in the flow channel; discharging of the fuel/air mixture from the flow channel via an internal outlet; supplying the fuel/air mixture to the combustion chamber of a burner via a swirler outlet.

Owing to the fuel being supplied via injection orifices both in the first wall and in the second wall, the method enables a more homogeneous distribution of the fuel over the entire cross-section of the flow channel. The homogeneous distribution of the fuel effects a better mixing of the fuel with the air and thus ensures low-NOx combustion.

An advantageous embodiment of the method according to the invention provides that at the same time as the fuel is supplied via the injection orifices in the first wall and in the second wall, fuel is supplied to the flow channel via injection orifices in the vanes.

As a result of the simultaneous supplying of fuel via injection orifices in the vanes, an even more homogeneous distribution of the fuel over the cross-section of the flow channel is achieved. In this case the fuel can be injected into the flow channel unilaterally via one vane or bilaterally via both vanes.

BRIEF DESCRIPTION OF THE DRAWINGS

Exemplary embodiments and further advantages of the invention are explained below with reference to the schematic drawings, in which.

The figures are in each case greatly simplified schematics in which only the essential components necessary for describing the inventions are shown. Identical or functionally identical components are labeled with the same reference signs throughout all the figures.

DETAILED DESCRIPTION OF INVENTION

Figure 1:
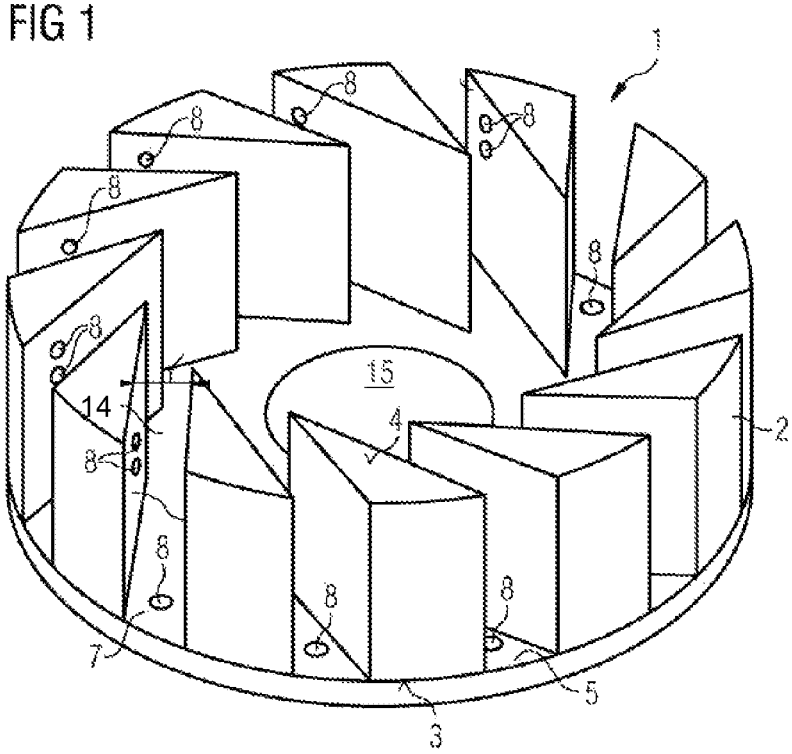
FIG. 1 shows a perspective plan view onto a swirler according to the invention.

FIG. 1 shows a perspective plan view onto a swirler 1 according to the invention. The swirler 1 comprises a plurality of vanes 2 spaced apart from one another and arranged on a reference circle diameter. Each vane 2 has a first longitudinal end face 3 and a second longitudinal end face 4. The vanes 2 are disposed with their first longitudinal end faces 3 on a first wall 5 which is preferably embodied as a circular disk. The vanes 2 are disposed with their second longitudinal end face 4 on a second wall 6 which is in turn preferably embodied as circular. The second wall 6 is not shown in FIG. 1 in order thereby to be able to better illustrate the arrangement of the vanes 2 and the injection orifices 8. Two adjacent vanes 2 in each case form a flow channel 7 together with the first wall 5 and the second wall 6. Disposed in the first wall 5 and in the second wall 6 in the region of the flow channel 7 in each case are injection orifices 8 through which fuel can be injected into the flow channel 7. Further injection orifices are preferably disposed in the vanes 2 in addition to said injection orifices 8. As a result of the arrangement of the injection orifices 8, both in the first wall 5 and in the second wall 6 as well as in the vanes 2, a particularly homogeneous injection of the fuel over the entire cross-section of the flow channel 7 is achieved. This produces a very good mixing of the fuel with the air streaming through the swirler 1 from the outside to the inside.

Figure 2:
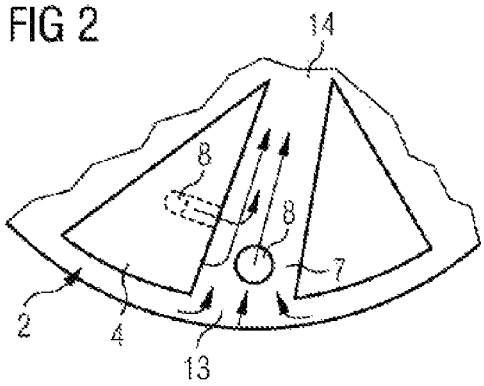
FIG. 2 shows a partial view of the inventive swirler according to FIG. 1.

FIG. 2 shows a plan view onto two vanes 2 situated adjacent to each other according to FIG. 1. The vanes 2 are, as already described, spaced apart from each other in such a way that a flow channel 7 is formed between the two vanes 2 as well as the first wall 5 and the second wall 6 (not shown). The air is supplied to the swirler 1 from outside. The inflowing stream of air is represented symbolically by the reference sign 12. The air enters the flow channel 7 through an inlet 13. At the same time fuel is injected into the flow channel 7 via the injection orifices 8 which are disposed inside the flow channel 7. The arrangement of the injection orifices 8 both in the first wall 5 and in the second wall 6 as well as preferably in at least one of the two vanes 2 results in a particularly homogeneous injection of the fuel over the entire cross-section of the flow channel 7. The turbulent air flow in the flow channel 7 causes the fuel to mix uniformly with the air. The fuel/air mixture exits the flow channel 7 at the outlet 14 and subsequently streams through the swirler outlet 15, from where it is supplied to a combustion chamber (not shown). The good mixing of the air with the fuel results in very homogeneous combustion in the combustion chamber. Owing to the homogeneous combustion no zones in which an increased fuel fraction is present (hotspots) are formed in the combustion chamber. This would otherwise cause local increases in combustion temperature, with the consequence of increased NOx emissions. The homogeneous blending of the fuel/air mixture thus ensures environmentally friendly and low-emission operation of the burner.

Figure 3:
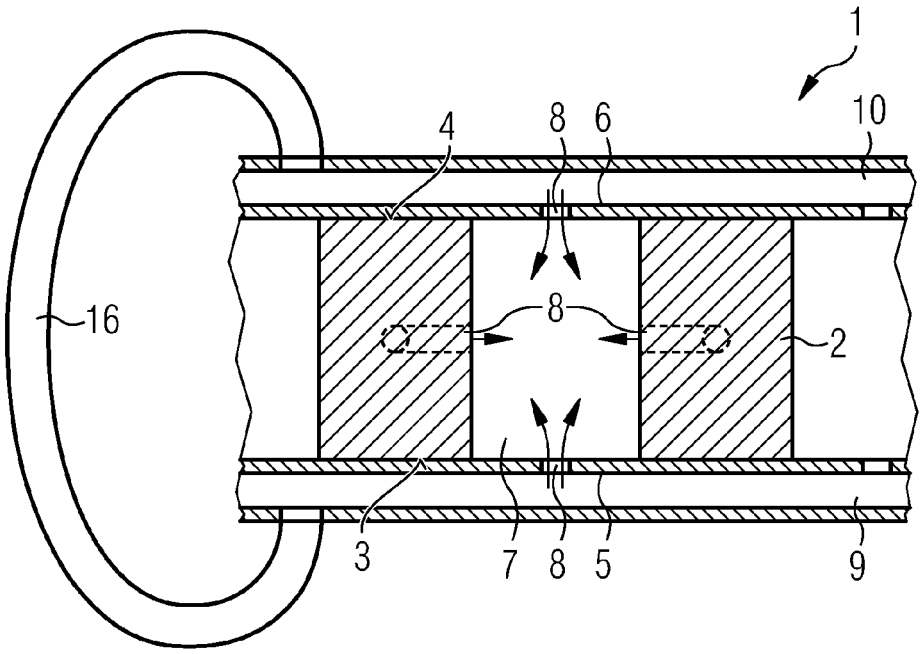
FIG. 3 shows a partial section through the inventive swirler according to FIG. 1.

FIG. 3 shows a longitudinal section through two vanes 2 arranged adjacent to each other according to FIG. 2. The injection orifices 8 in the first wall 5 are interconnected via a first annular channel 9 and the injection orifices 8 in the second wall 6 are interconnected via a second annular channel 10. The fuel can be supplied to the injection orifices via the annular channels 9, 10. The annular channels 9 and 10 are preferably embodied in such a way that a wall of the annular channel simultaneously fauns the first wall 5 and the second wall 6, respectively, of the swirler 1. This results in a particularly simple design of the swirler 1. An additional installation of the annular channel on the first and second wall 5, 6 can thus be omitted, thereby removing the risk of leaks in this area. The injection orifices 8 in the first wall 5 and the opposing injection orifice 8 in the second wall 6 are disposed in such a way that they align axially with one another. When the fuel stream is discharged, the two injection jets collide with each other, resulting in a particularly fine and homogeneous distribution of the fuel.

Obviously a different, non-aligning arrangement of the injection orifices 8 is also conceivable. Also, a plurality of injection orifices 8 can be incorporated behind or adjacent to one another in the first wall 5 and/or the second wall 6.

The first annular channel 9 and the second annular channel 10 are preferably hydraulically interconnected via a line 16. What is achieved by the hydraulic connection is that the fuel pressure in the first annular channel 9 and in the second annular channel 10 is largely the same. As a result a uniform injection velocity is achieved at the individual injection orifices 8. This leads to a uniform distribution of the fuel over the cross-section of the flow channel 7.

Another preferably embodiment provides that the first and the second annular channel have separate manifold feeds. Through this it is possible, dependent on the demand, to inject fuel via one or both annular channels in the flow channel.

The first and/or second annular channel 9, 10 are/is preferably embodied integrally with the swirler 1 as a single piece. The single-piece embodiment reduces the number of line junctions, thereby diminishing the risk of leaks at the swirler 1 as well as increasing component reliability. Obviously it is also possible to embody the first and/or second annular channel 9, 10 as separate components. This has the advantage that the annular channel can be better adapted to different operating conditions.

Figure 4:
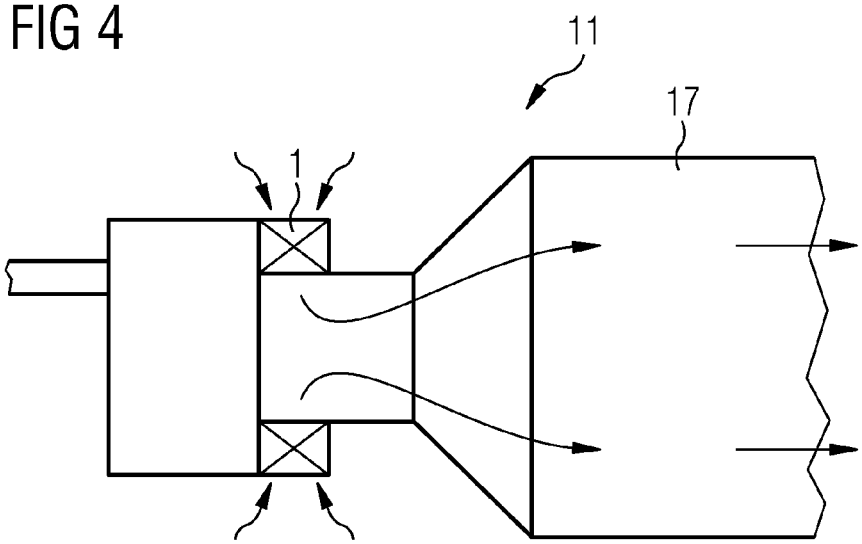
FIG. 4 shows a view of a burner according to the invention having a swirler according to FIG. 1.

FIG. 4 shows a longitudinal section through a burner 11 which is particularly suitable for gas turbines. The burner 11 has an inventive swirler 1 which is positioned upstream of the combustion chamber 17. The swirler 1 according to the invention is suitable particularly advantageously for burners for gas turbines since the combustion temperature in the case of gas turbines is very high and frequently temperatures in excess of 2000° prevail in the combustion chamber. High NOx emissions are produced at these temperatures. Said emissions can be substantially reduced by the uniform combustion of the homogeneous fuel/air mixture.

To sum up, it can be stated that a particularly fine and homogeneous distribution of the fuel over the flow cross-section of the flow channel 7 can be achieved by means of the arrangement of the injection orifices 8 both in a first wall 5 and in an opposing second wall 6 of the flow channel 7. This leads to a particularly uniform mixing of the fuel with the air. Said uniform mixing of the fuel/air mixture makes for uniform combustion in the combustion chamber of the burner and consequently results in a uniform and low combustion temperature. The NOx emissions are effectively reduced in this way.

The invention claimed is:

1. A swirler for mixing fuel and air, comprising:

a plurality of vanes arranged on a reference circle which, together with a first wall disposed on a first longitudinal end face of the plurality of vanes, and a second wall disposed on a second longitudinal end face of the plurality of vanes, form a flow channel, and wherein the first wall include a first injection orifice, and the second wall includes a second injection orifice, resulting in opposed injection orifices opening into the flow channel, and wherein the injection orifice in the first wall is connected to a first annular channel and the injection orifice in the second wall is connected to a second annular channel, and the first and second annular channels are concentric with the reference circle.

2. The swirler as claimed in claim 1, wherein the opposed injection orifices in the first wall and the second wall are arranged in axial alignment with one another.

3. The swirler as claimed in claim 1, wherein a plurality of additional injection orifices are disposed in the plurality of vanes.

4. The swirler as claimed in claim 1, wherein the first annular channel and the second annular channel are hydraulically interconnected.

5. The swirler as claimed in claim 1, wherein the first annular channel and the second annular channel include separate manifold feeds.

6. The swirler as claimed in claim 1, wherein the first and/or the second annular channel are embodied integrally with the swirler as a single piece.

7. The swirler as claimed in claim 6, wherein the first and/or second wall are part of the first and second annular channel respectively.

8. A burner, comprising:

the swirler according to claim 1.

9. The burner as claimed in claim 8, wherein the burner is used on a gas turbine.

10. The burner as claimed in claim 8, wherein the opposed injection orifices are arranged in axial alignment with one another.

11. The burner as claimed in claim 8, wherein a plurality of additional injection orifices are disposed in the plurality of vanes.

12. The burner as claimed in claim 8, wherein the first annular channel and the second annular channel are hydraulically interconnected.

13. The burner as claimed in claim 8, wherein the first annular channel and the second annular channel include separate manifold feeds.

14. The burner as claimed in claim 8, wherein the first and/or the second annular channel are embodied integrally with the swirler as a single piece.

15. The burner as claimed in claim 14, wherein the first and/or second wall are part of the first and second annular channel respectively.

16. A method for mixing air and fuel using a swirler, the method comprising:

supplying air into a flow channel through an external inlet of the swirler;

supplying fuel via a first plurality of injection orifices which are disposed both in a first wall on a first longitudinal end face of a vane and in an opposing second wall disposed on a second longitudinal end face of the vane of the swirler;

distributing the fuel over a cross-section of the flow channel;

mixing the fuel and the air in the flow channel;

discharging of the fuel/air mixture from the flow channel via an internal outlet of the swirler;

supplying the fuel/air mixture to a combustion chamber of a burner via a swirler outlet; and wherein injection orifice in the first wall is connected to a first annular channel defining a first plane and injection orifice in the second wall is connected to a second annular channel defining a second plane, and wherein the first plane is parallel to the second plane and the vane is in between the planes.

17. The method for mixing air and fuel as claimed in claim 16, wherein at the same time as the fuel is supplied via the plurality of first injection orifices in the first wall and in the opposing second wall, fuel is supplied to the flow channel via a second plurality of injection orifices in a plurality of vanes.

18. A gas turbine comprising:

a burner including a swirler for mixing fuel and air, the swirler including a plurality of vanes arranged on a reference circle, each vane having a first wall and a second wall; wherein said first wall of one of the plurality of vanes, and said second wall of an adjacent vane of the plurality of vanes define a flow channel therebetween, said flow channel arranged to mix air with fuel from a high pressure side to a low pressure side; and wherein said first wall of one of the plurality of vanes and said second wall of said adjacent vane of the plurality of vanes includes opposed orifices opening into said flow channel, wherein the opposed orifices are connected to first and second annular channels, and the annular channels are concentric with the reference circle.

* * * * *